US006408836B1

(12) United States Patent
Ming-Hsien

(10) Patent No.: US 6,408,836 B1
(45) Date of Patent: Jun. 25, 2002

(54) BULLET FEEDING DEVICE FOR PNEUMATIC TOY GUNS

(76) Inventor: Chen Ming-Hsien, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/751,818

(22) Filed: Jan. 2, 2001

(51) Int. Cl.[7] ..... F41B 11/02
(52) U.S. Cl. ..... 124/49
(58) Field of Search ..... 124/49, 50, 73

(56) References Cited

U.S. PATENT DOCUMENTS 2,574,408 A * 11/1951 Moe
3,789,891 A * 2/1974 Bosch
4,241,716 A * 12/1980 Tsui
5,285,765 A * 2/1994 Lee
5,673,679 A * 10/1997 Walters

* cited by examiner

*Primary Examiner*—John A. Ricci
(74) *Attorney, Agent, or Firm*—Charles E. Baxley

(57) ABSTRACT

A pneumatic toy gun includes a barrel having a groove and two first holes extending therethrough. A bullet feeding device is connected to the barrel. The feeding device includes a first part and a second part, wherein the first part has a feeding tube. The second part has a protrusion extending therefrom so as to be inserted into the groove in the barrel. The first part is then connected to the second part by screws. The connection of the protrusion and the groove set the second part in position so that the feeding tube can be positioned at a desired position when the two parts are in connection with each other.

2 Claims, 5 Drawing Sheets

BULLET FEEDING DEVICE FOR PNEUMATIC TOY GUNS

FIELD OF THE INVENTION

The present invention relates to a bullet feeding device for pneumatic toy guns and the device includes two parts. One of the two parts has a protrusion for being inserted in a groove in a barrel of the gun so as to precisely position the feeding hole in the device.

BACKGROUND OF THE INVENTION

A conventional bullet feeding device for a pneumatic toy gun is shown in FIG. 1 and generally includes a tubular body 10 connected to a barrel 1 of the toy gun. A hole 11 is defined through the barrel 1 and is in communication with a feeding hole 100 defined in the body 10. An end member 13 is connected to a lower end of the body 10 and a seal 14 seals the gap between the body 10 and the end member 13. Bullets 15 are put in the body 10 from a top open end of the body 10 and the lowest bullet 15 contacts an inclined surface of the end member 13 so as to roll into the barrel 1 via the hole 11 and the feeding hole 100. The body 10 is welded to the barrel 1 and the position of the body 10 relative to the barrel 1 affects the movement path of the bullets 15. Because the connection of the body 10 and the barrel 1 is set by hands so that the connection angle of the body 1O and the barrel 1 could not be well positioned and the bullets 15 cannot enter the barrel 1 smoothly.

The present invention intends to provide a feeding device that is easily to be connected to the barrel and the position of the feeding hole can be precisely set.

SUMMARY OF THE INVENTION

In accordance with one aspect of the present invention, there is provided a pneumatic toy gun with a bullet feeding device. The gun has a groove and two first holes respectively defined through a barrel of the gun and the bullet feeding device comprises a first part and a second part. The first part has a feeding tube with an open top and a feeding hole defined in a lower end of the feeding tube. A first flange extends from the first part. The second part has a protrusion extending therefrom so as to be inserted into the groove in the barrel. Two second holes are defined through the second part and two screws extend through the second holes and are engaged with the barrel. A second flange extends from the second part so as to be connected to the first flange.

The primary object of the present invention is to provide a bullet feeding device which can be easily can precisely connected to a desired position on the barrel.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
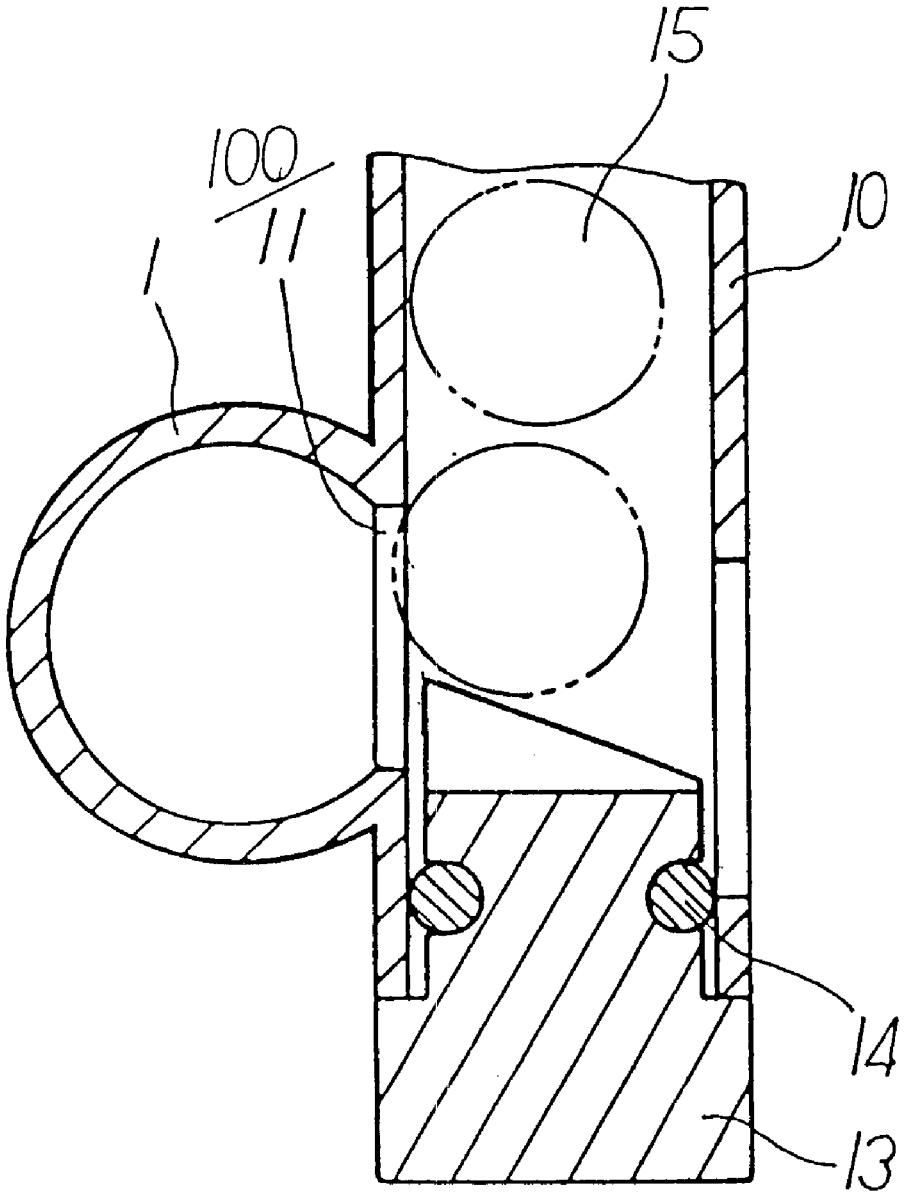
FIG.1 PRIOR ART
FIG. 1 is a cross sectional view to show a conventional bullet feeding device for a pneumatic toy gun.
Figure 2:
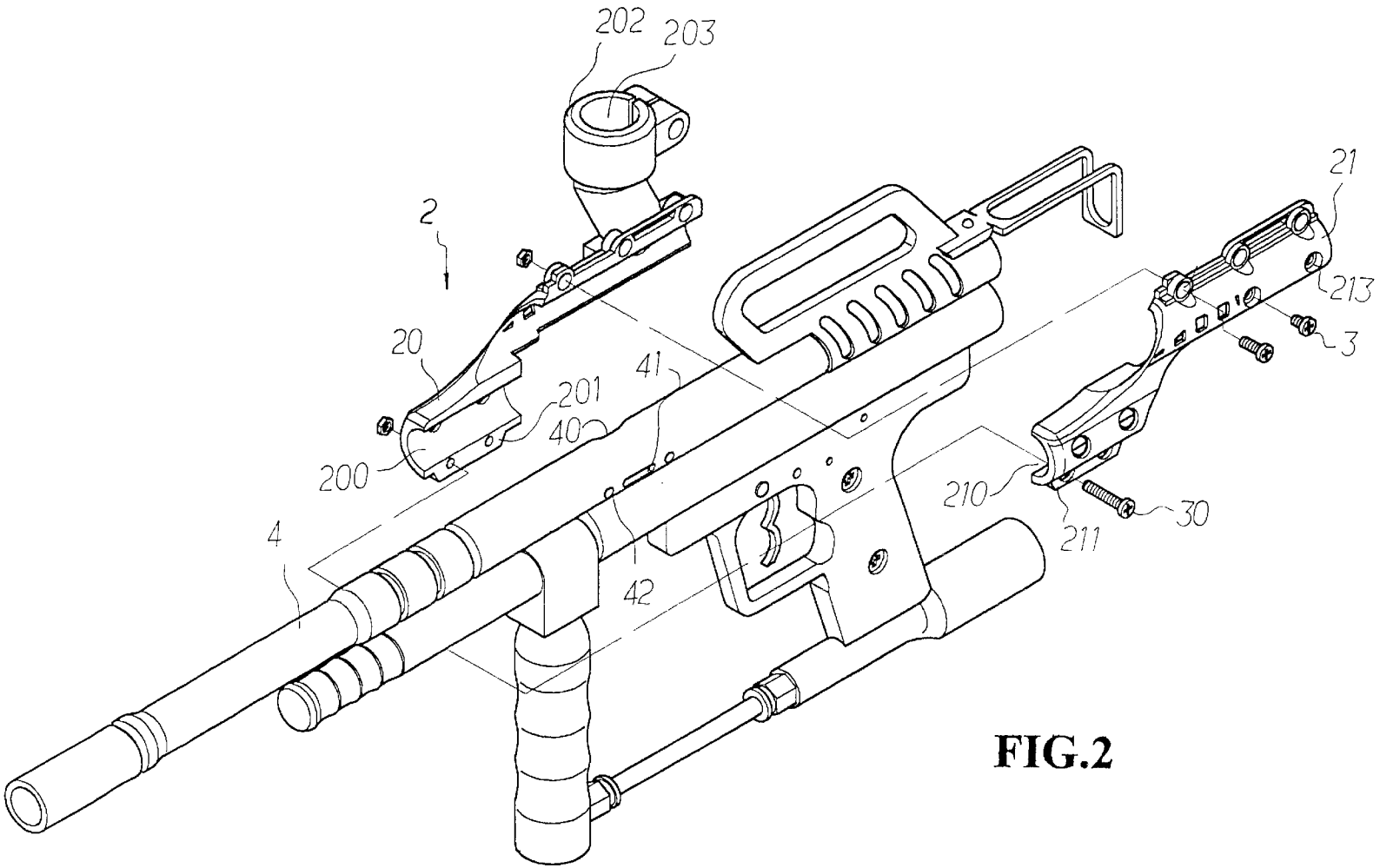
FIG. 2 is an exploded view to show a bullet feeding device of the present invention and a pneumatic toy gun.
Figure 3:
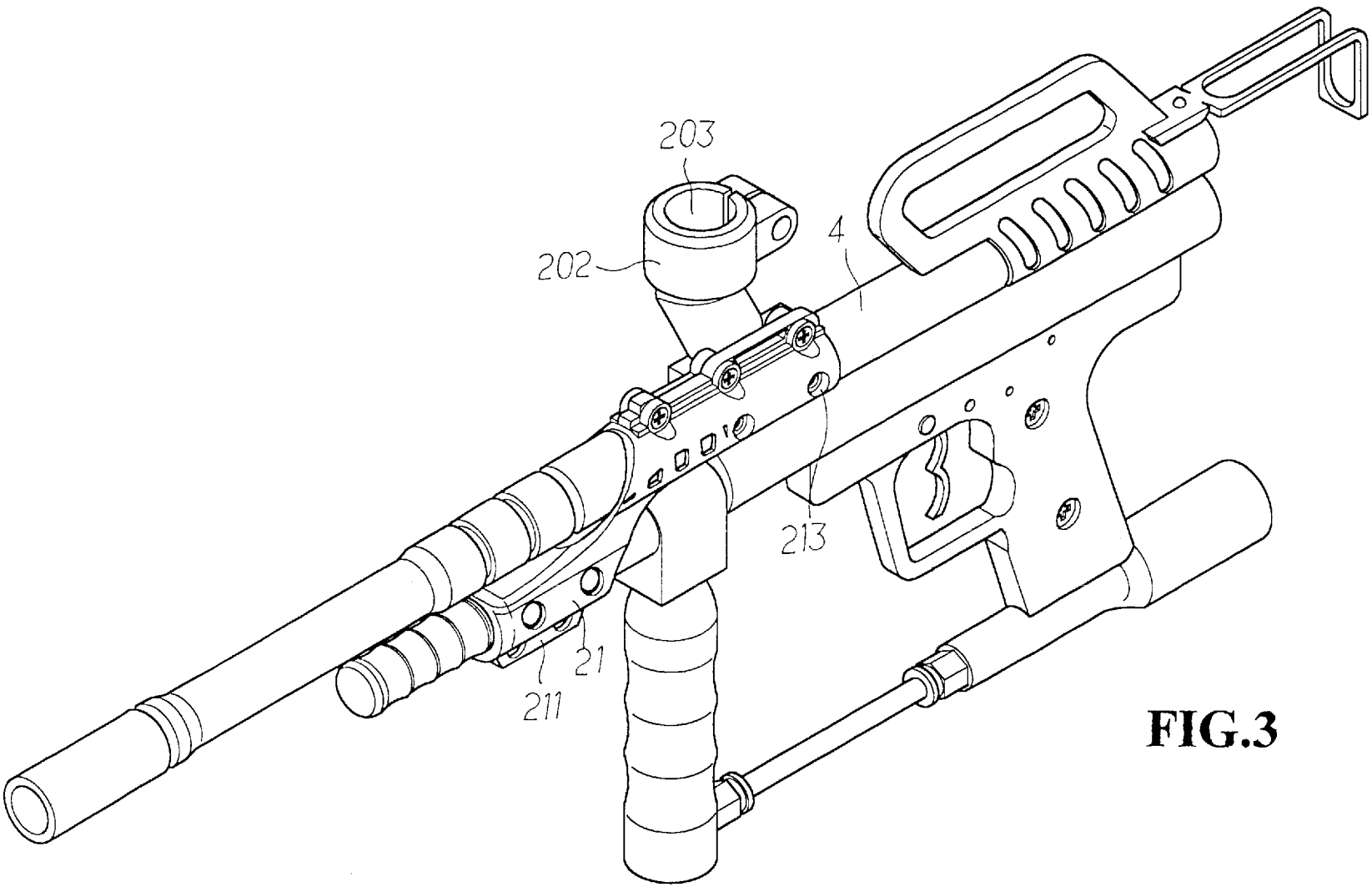
FIG. 3 is a perspective view to show the bullet feeding device of the present invention connected to the pneumatic toy gun.
Figure 4:
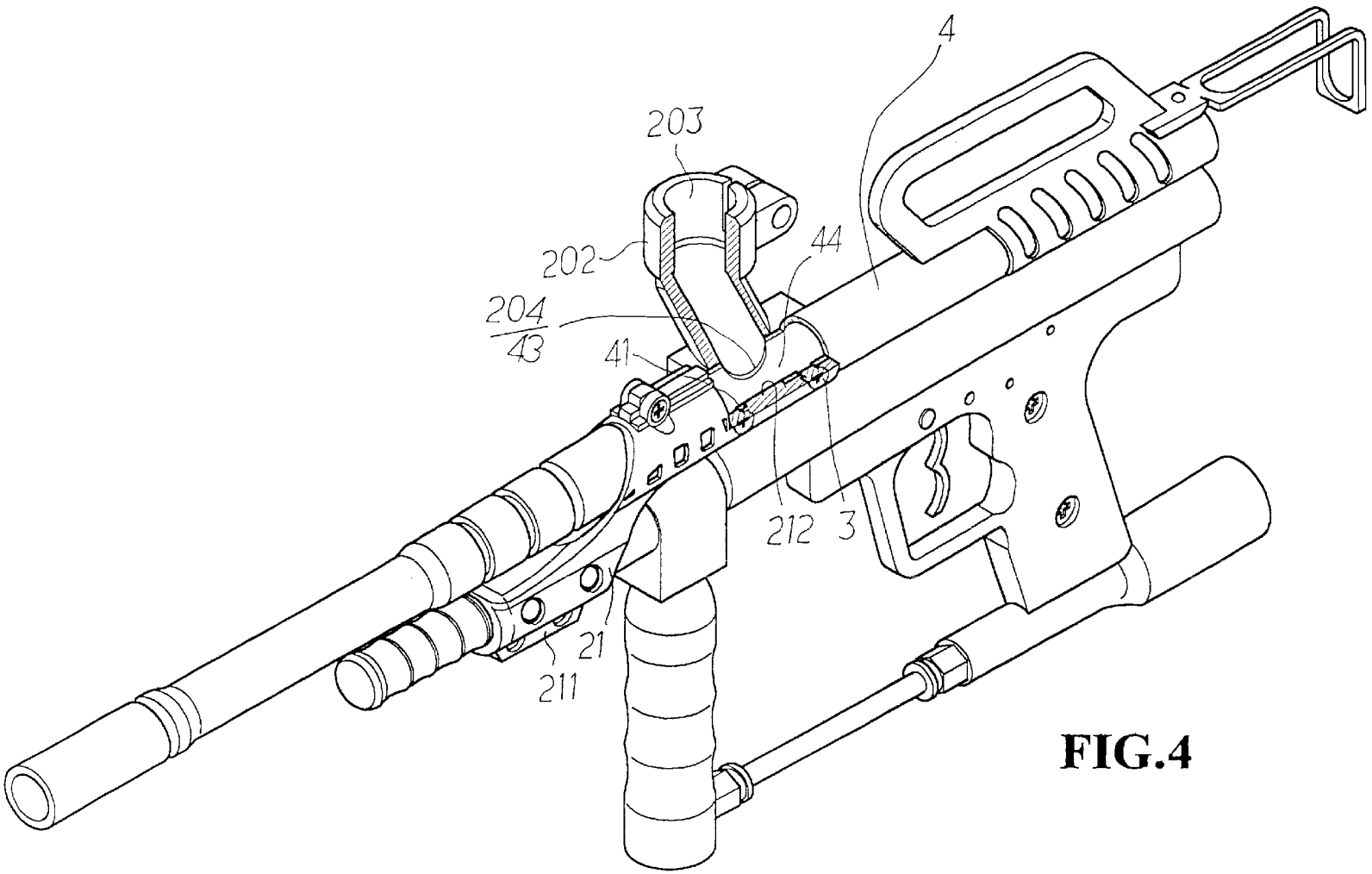
FIG. 4 is a perspective view, partly removed, to show a feeding tube of the bullet feeding device communicates with an interior of the barrel of the pneumatic toy gun.
Figure 5:
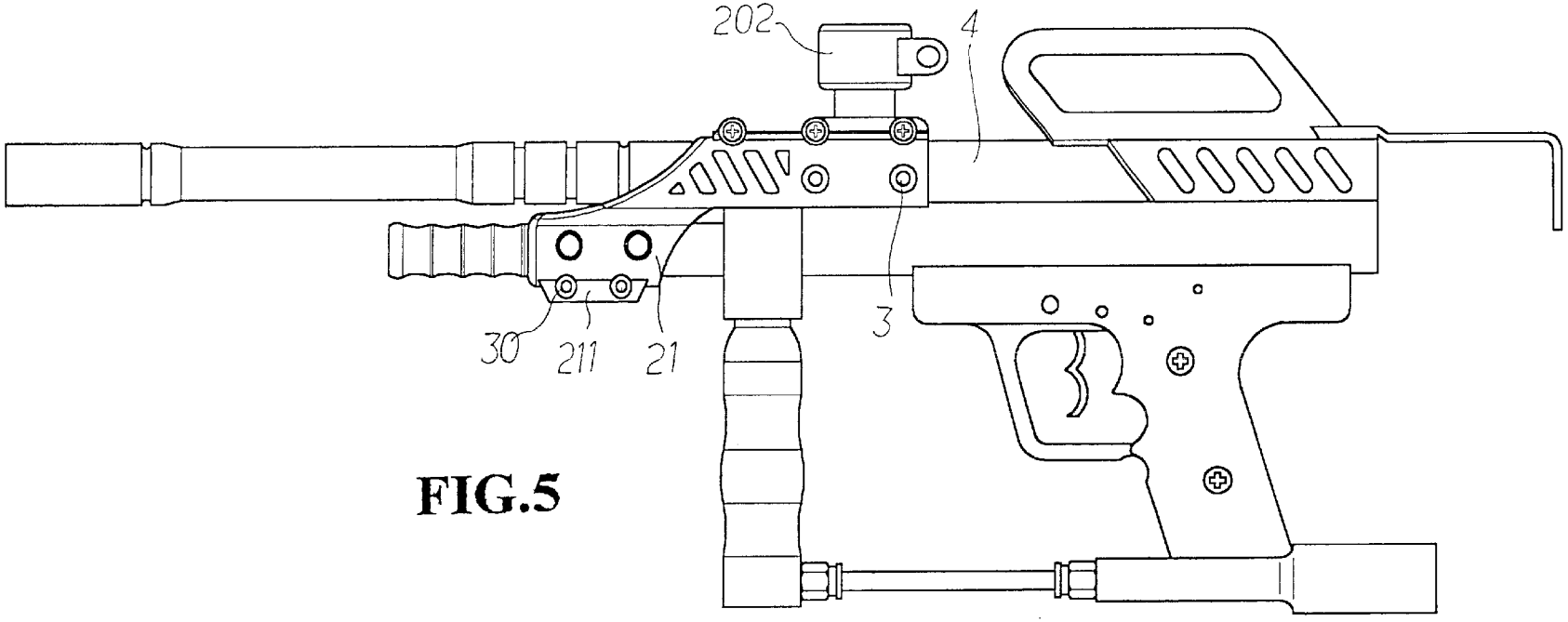
FIG. 5 is a sides elevational view to show the pneumatic toy gun with the bullet feeding device of the present invention connected thereto.

Referring to FIGS. 2 to 5, the bullet feeding device 2 of the present invention comprises a first part 20 and a second part 21. The first part 20 has a feeding tube 202 with an open top 203 and a feeding hole 204 defined in a lower end of the feeding tube 202. A first flange 201 extends from the first part 20 and two holes are defined through the first flange 201. The second part 21 has a protrusion 212 extending therefrom and two first holes 213 are defined through the second part 21. A second flange 211 extends from the second part 21 and two holes are defined through the second flange 211.

The pneumatic toy gun has a groove 41 and two first holes 42 respectively defined through a barrel 4 of the gun and an inlet 43 is defined through the barrel 4. The inlet 43 communicates with an interior of the barrel 4.

When assembling the bullet feeding device 2 to the barrel 4, the protrusion 212 of the second part 21 is inserted into the groove 41 in the barrel 4 so as to initially position the second part 21. Two second holes 42 are defined in the barrel 4 with the groove 41 located between the two second holes 42. Two screws 3 extend through the first holes 213 and engaged with the second holes 42 in the barrel 4. The first part 20 is then connected to the second part 21 by extending screws 30 through the holes in the first flange 201 and the second flange 211 so as to connect the first flange 201 and the second flange 211.

Because the second part 21 is precisely positioned to the barrel 4 by the connection of the groove 41 and the protrusion 212 so that when the first part 20 is connected to the second part 21, the feeding hole 204 matches with the inlet 43 precisely. The position of the groove 41 and the protrusion 212 also makes the assemble of the bullet feeding device 2 easily and quickly.

While we have shown and described various embodiments in accordance with the present invention, it should be clear to those skilled in the art that further embodiments may be made without departing from the scope and spirit of the present invention.

What is claimed is:

1. A pneumatic toy gun with a bullet feeding device, comprising:

a groove and two first holes respectively defined through a barrel of said gun, and said bullet feeding device comprising a first part and a second part, said first part having a feeding tube with an open top and a feeding hole defined in a lower end of said feeding tube, a first flange extending from said first part, said second part having a protrusion extending therefrom so as to be inserted into said groove in said barrel, two second holes defined through said second part and two screws extending through said second holes and engaged with said barrel, a second flange extending from said second part so as to be connected to said first flange.

2. The gun as claimed in claim 1, wherein each of said first flange and said second flange has two holes for screws extending therethrough so as to connect said first flange and said second flange.

* * * * *